US006860626B2

(12) United States Patent
Lampen et al.

(10) Patent No.: US 6,860,626 B2
(45) Date of Patent: Mar. 1, 2005

(54) HEADLIGHT

(75) Inventors: Martin Lampen, Tuebingen (DE); Matthias Gebauer, Reutlingen (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 78 days.

(21) Appl. No.: 10/335,841

(22) Filed: Jan. 2, 2003

(65) Prior Publication Data

US 2003/0156423 A1 Aug. 21, 2003

(30) Foreign Application Priority Data

Jan. 8, 2002 (DE) ..... 102 00 357

(51) Int. Cl.[7] ..... F21V 9/00
(52) U.S. Cl. ..... 362/511; 362/509; 362/581
(58) Field of Search ..... 362/511, 509, 362/581, 31

(56) References Cited

U.S. PATENT DOCUMENTS 4,631,642 A * 12/1986 Brun ..... 362/581
5,984,497 A * 11/1999 Foerstner et al. ..... 362/511
2003/0063473 A1 * 4/2003 Aynie et al. ..... 362/509

* cited by examiner

*Primary Examiner*—Stephen Husar
*Assistant Examiner*—James W Cranson
(74) *Attorney, Agent, or Firm*—Michael J. Striker

(57) ABSTRACT

A headlight, in particular, for motor vehicles, has an elongated incandescent body (2) with an incandescent body longitudinal axis (4), a reflector, associated with the incandescent body (2) for bundling of the light emitted from the incandescent body (8), and a photoconductor (8), in which the light emitted from the reflector (6) in the direction of an optical axis is coupled-in by means of a coupling-in surface (12) of the photoconductor (8). The incandescent body longitudinal axis (4) forms an angle ($\alpha$) with the optical axis (10) that is greater than 0 degrees.

14 Claims, 2 Drawing Sheets

Fig. 3
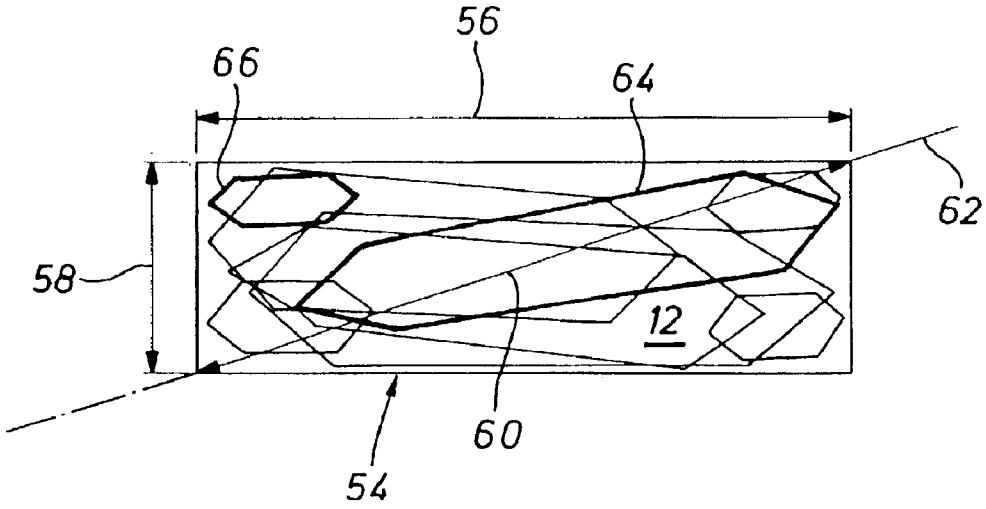
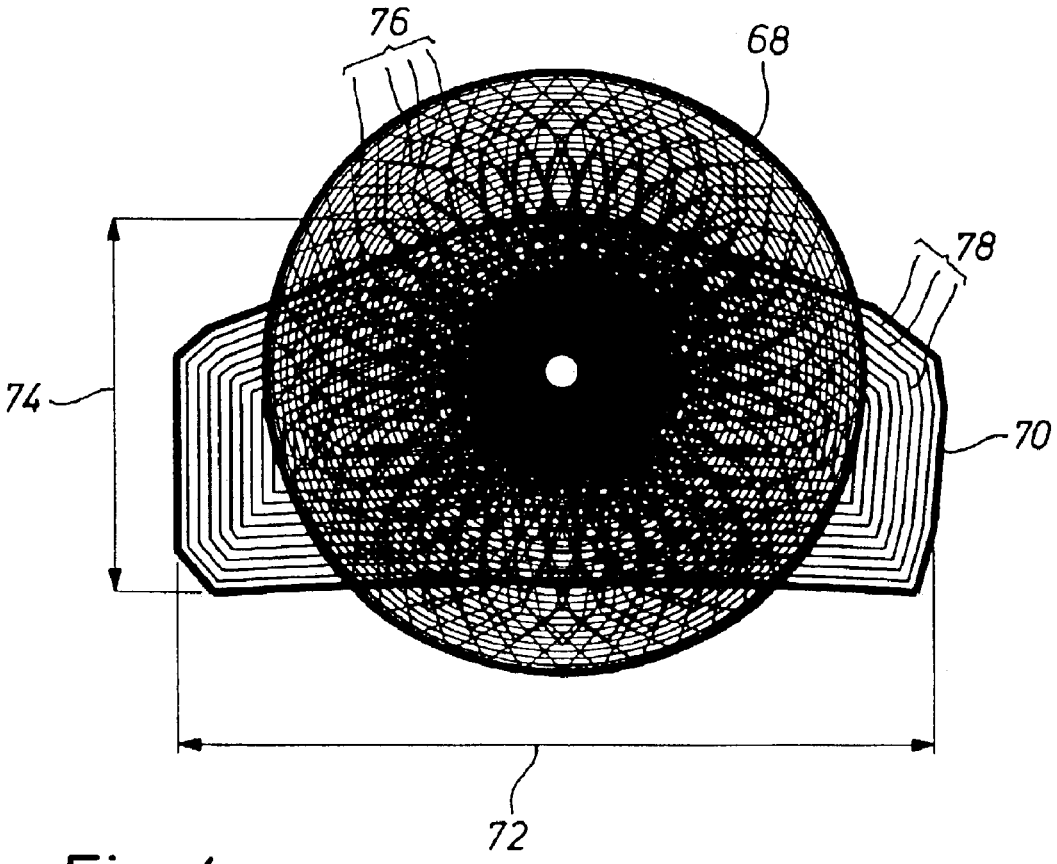
Fig. 4

HEADLIGHT

BACKGROUND OF THE INVENTION

The present invention relates to a headlight, in particular, for a motor vehicle, with an elongated incandescent body with an incandescent body axis, with a reflector associated with the incandescent body for beaming or bundling of the light emitted from the incandescent body, as well as with a photoconductor, in which the emitted light from the reflector in the direction of an optical axis is coupled in by means of a coupling-in surface of the photoconductor.

This type of headlight is known from the prior art. Photoconductor elements are used more than other components, because they can be made with varying structures. The design freedom of elements for the outer illumination of motor vehicles includes an increasingly greater meaning for the appearance of a vehicle. An aesthetically pleasing design of the vehicle and the elements for the outer illumination makes possible the production of different features in contrast to competing motor vehicle productions on the market.

The use of photoconductor elements has the advantage that a spatial separation between the production of the light by means of a light source on the one hand and the radiation of the light in an outer region of the motor vehicle on the other hand can take place. In this connection, it is necessary that the light produced is conducted to a point via photoconductors of the respective elements, which, in particular, can be provided in the photoconductor itself and which radiates the light in an outer region of the motor vehicle. The photoconductors can be installed as desired in the motor vehicle and demand proportionally little space. For coupling-in of the light in the photoconductor, a light source is used for radiating the light that is bundled from a reflector and is coupled in an end cross section of the photoconductor. The end cross section of the photoconductor is subsequently designated as the "coupling-in surface". The photoconductor conducts the light further, then relatively loss-free, to the so-called "uncoupling location".

According to the state of the art, devices for a photoconducting coupling-in are known, in which an elongated incandescent body with an incandescent body longitudinal axis is directed axially parallel to an optical axis, along which the central longitudinal axis of a photoconductor with a circular cross section, at least in the area of the coupling-in surface, is arranged. That is, the optical axis cuts the coupling-in surface and does this preferably at a 90° angle. These types of devices have the disadvantage that the cross section of the photoconductor, or its coupling-in surface, must be relatively large and reflection of the light source is a little compressed. Thus, the brightness separation is produced on the coupling-in surface of the photo conducting elements, which is optimal only in partial regions.

The present invention addresses the underlying problem of making available a headlight, in particular, for motor vehicles, with which an advantageous brightness separation on the coupling-in surface of a photoconductor element is produced with the smallest possible cross section of the coupling-in surface.

SUMMARY OF THE INVENTION

The above-stated problem is resolved with a headlight according to the present invention, whose incandescent body's longitudinal axis forms an angle with the optical axis that is greater than 0°.

The incandescent body used in the headlight is elongated and has an incandescent body longitudinal axis. This incandescent body is associated with a reflector for bundling of the light radiated from the incandescent body. The emitted light is coupled-in in the direction of an optical axis in a coupling-in surface of a photoconductor. In this manner, the individual light beams do not run necessarily completely parallel to the optical axis. The light emission direction, however, can be described essentially through the optical axis. The optical axis corresponds, therefore, also to the longitudinal axis of the reflector. The central longitudinal axis of the photoconductor overlaps with the direction of the optical axis at least in the region of the coupling-in surface. In particular, however, the optical axis cuts the coupling-in surface, preferably at a 90° angle. The optical axis and the incandescent body longitudinal axis, then, do not form an angle of 0°, as with common systems, rather an angle deviating there from. Advantageously, the angle between the incandescent body and the optical axis is 90°; however, the angle also can be in a range of between 0 and 90°, that is, in a range of 0–30°, 30–45°, 45–60°, or 60–90°. It is important, that the incandescent body longitudinal axis and the optical axis from an angle with one another that is not 0°. In this manner, it is possible that the incandescent body images emitted from the incandescent body and bundled from the reflector can be more greatly compressed and the coupling-in surface of the photoconductor can be selected to be substantially smaller than with conventional photoconductor coupling-in devices. In particular, incandescent body images are achievable, which have a large or small projection surface. The arrangement of the incandescent body images and the frequency of the varying large and small projection surfaces make possible an adaptation of the coupling-in surface of the photoconductor, as well as the entire cross section of the photoconductor to the effect that a minimization is achieved, compared with common, axial photoconductor coupling-in devices.

The cross section of the photoconductor and/or its coupling-in surface can deviate from a circular shape and have a varying extension in the longitudinal and transverse direction. Approximately square or elliptical or rhombus shapes are contemplated, for example. The maximal extension of the photoconductor runs with an elliptical or rhombus shape of the photoconductor and/or its coupling-in surface in the direction of the longitudinal extension of the cross section. With an ellipse, this corresponds with the direction of the longitudinal radius and with a rhombus, with the direction of the longitudinal diagonal. In the case of a photoconductor and/or a coupling-in surface with an approximately square shape, the maximal extension of the cross section runs in a direction, which diverges from the direction of the longitudinal extension of the square cross section, namely, in the direction of one of the diagonals. The noted shapes represent advantageous examples; however, all cross sections of the photoconductor and/or coupling-in surface that depart from a circular shape are possible.

To achieve a homogenous brightness separation, it is advantageous that the photoconductor is arranged such that the incandescent body image with the large projection surface lies parallel to the maximum extension of the coupling-in surface. The images with the large projection surface extend in the direction of the maximal extension of the coupling-in surface, as well as parallel thereto. Therefore, the orientation of the incandescent body image with the large projection surface are not varied about 360°, as with common devices for photoconducting coupling with photo conductors having circular cross sections; rather, the orientation of the incandescent body image with the large projection surface is determined based on the maximum extension of the coupling-in surface. In order to achieve an advantageous brightness separation, it is also advantageous that the incandescent body image is coupled in with small projection surfaces in the region of the coupling-in surfaces, which are not covered, or only partially covered, by the incandescent body images with large projection surfaces. It can therefore be provided that the reflector is correspondingly designed.

For the proposed arrangement of the incandescent body, reflector, and photoconductor, or incandescent body longitudinal axis and optical axis, it is not important if the incandescent body, that is, the element which directly emits light, is held by an element that has a longitudinal axis that runs in the direction of the incandescent longitudinal axis or if the element supporting the incandescent body is arranged in the direction of the optical axis or in a desired intermediate position between the optical axis and the incandescent body longitudinal axis. It is only important that the light-emitting element, that is the incandescent body with its incandescent body longitudinal axis from an angle with the optical angle that is greater than 0°. The incandescent body, as well as the incandescent coils, is formed such that the use of conventional incandescent lamps is possible. It can also be structured, however, from an arc lamp, which, for example, is can be made from a gas discharge tube, or glow lamp. Other incandescent body designs are also contemplated, however, as long as these have a longitudinal extension.

Further advantageous forms and features of the invention are provided in the following description as well as the above disclosure, in which the invention is described and explained in detail with reference to the accompanying drawings.

BRIEF DESCRIPTION OF THE DRAWINGS

FIG. 3 shows a plane view on a coupling-in surface; and

FIG. 4 shows an incandescent body image on coupling-in surfaces of two photoconductors.

DETAILED DESCRIPTION OF THE PREFERRED EMBODIMENTS

Figure 1:
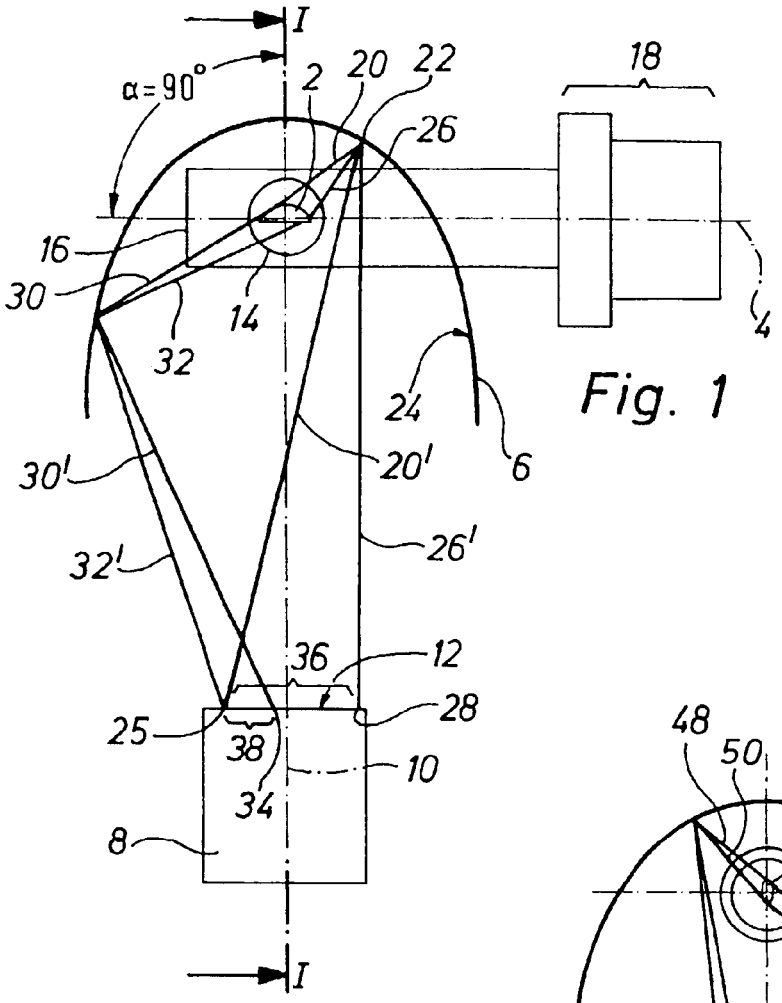
FIG. 1 shows a sectional view of the headlight of the present invention.

In FIG. 1, an elongated incandescent body 2 with an incandescent body longitudinal axis 4 is illustrated, whereby the incandescent body is associated with a reflector 6, which deflects light emitted from the incandescent body 2 in the direction of an optical axis 10 and which is coupled in a photoconductor 8. The photoconductor 8 has a coupling-in surface 12. The incandescent body longitudinal axis 4 and the optical axis 10 are disposed at an angle $\alpha$=90° from one another.

The incandescent body 2 is arranged in a retainer element 14, which in turn, is hold by a glass bulb. The glass bulb 16 is fixed in a socket 18.

The incandescent body 2, that is, the light-producing element, has an arc-shaped structure and is, for example, produced by means of a gas discharge. A light beam 20 emitted from this incandescent body 2 impinges in a reflection point 22 of the inner side 24 of the reflector 6 and is there diverted in the direction 20' on the coupling-in surface 12. A light beam 26 is likewise diverted in the reflection point 22 in the direction 26' and impinges in a coupling-in point 28 on the coupling-in surface 12. The light beams 30 and 32, which are emitted from the incandescent body 2, are diverted in the direction 30' or 32' from the reflector inner side 24 and impinge in the coupling-in point 25 and in a coupling-in point 34 on the coupling-in surface 12 of the photoconductor 8. The coinciding of the light beams 20' and 32' in a coupling-in point 25 can be determined by means of the structure of the reflector. However, also disintegration is possible and is achievable by means of a determined reflector construction.

The distance 36 between the coupling-in point 25 and 28 of the diverted light beams 20' and 26' is recognizably larger than the distance 38 between the coupling-in points 25 and 34 of the diverted light beams 30' and 32'. Thus, incandescent body images are projected on the coupling-in surface 12 of the photoconductor 8, whose extension is variably large.

Figure 2:
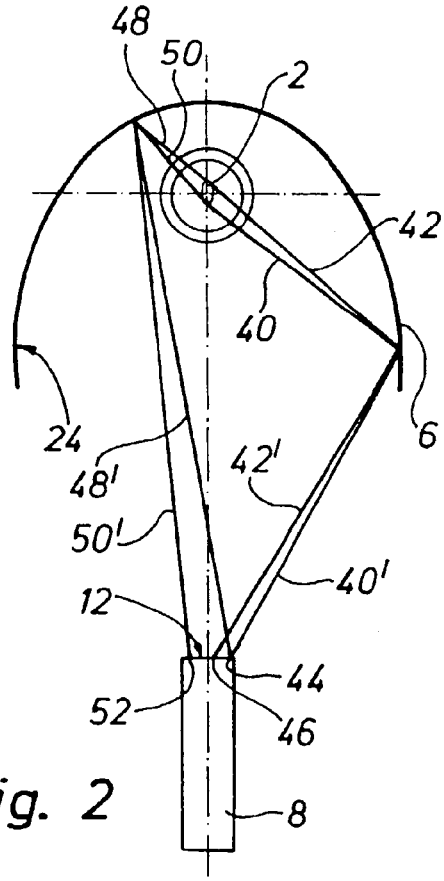
FIG. 2 shows a sectional view of the headlight in the plane I—I from FIG. 1.

FIG. 2 shows a sectional view of the headlight in the plane I—I in FIG. 1. The light beams emitted from the incandescent body 2 are projected from the inner side 24 of the reflector 6 onto the coupling-in surface 12 of the photoconductor. For example, the light beams 40 and 42 are diverted in the direction 40' and 42' and impinge in the coupling-points 44 and 46 on the coupling-in surface 12 of the photoconductor 8. In addition, the light beams 48 and 50 are diverted in the direction 48' and 50' and impinge in the coupling-in point 44 and in a coupling-in point 52 on the coupling-in surface 12. Also here, by means of the structures of the reflector and the positioning of the optical axis 10 to the incandescent axis 4, various sizes of incandescent body images are produced.

FIG. 3 shows a top plan view on the coupling-in surface 12, which is limited by a periphery 54 and has a longitudinal extension 56 as well as a transverse extension 58. The maximum extension of the cross section of the coupling-in surface 12 lies in the diagonal 60 of the diagonal direction 62. On the coupling-in surface 12, for example, individual incandescent body images are represented, from which, in turn, for example, an incandescent body image with a large projection surface 64 and an incandescent body image with a small projection surface are emphasized. The incandescent body image 64 extends essentially in the direction of the maximum extension 60 of the coupling-in surface 12. The incandescent body image 66 with the small projection surface lies in a region of the coupling-in surface 12, which is not covered or only partially covered by the incandescent body image 64 with the large projection surface.

With overlapping of the incandescent body images emphasized by way of example in FIG. 3 with large and small projection surfaces, it is clear that a brightness separation is achievable, in which the light separation is better utilized.

FIG. 4 shows two illustrated coupling-in surfaces lying over one another with peripheries 68 and 70. The periphery 60 is determined from an essentially circularly shaped photoconductor cross section, as used in headlights with conventional photoconductor coupling-in devices, that is, with which the optical coincides with the incandescent body longitudinal axis. The periphery 70 shows an inventive minimized embodiment of a photoconductor cross section with a longitudinal extension 72 and a transverse extension 74.

With use of conventional photoconductor coupling-in devices, incandescent body images are projected on a coupling-in surface with an essentially circular cross section. In FIG. 4, for example, individual coupling-in images 76 are shows. By overlapping of these coupling-in images, an impression can be introduced, in which brightness separation in the coupling-in surface of the photoconductor cross section is achievable. It is to be recognized from FIG. 4 that a homogenous and the brightness separation well-utilized by the photoconductor is only ensured in a central region of the photoconductor cross section 68. However, with an inventive arrangement and by using a photoconductor with the cross section 70, which is smaller, by overlapping of incandescent images 78 shown by way of example, a brightness separation is produced, which qualitatively at least corresponds to the brightness separation on the circular cross section 68 upon use of conventional photoconductor coupling-in devices. The spaced required by the photoconductor 70, however, is substantially smaller than the cross section of photoconductors with circular cross sections.

What is claimed is:

1. A headlight for motor vehicles, comprising:

an elongated incandescent body (2) with an incandescent body longitudinal axis (4);

a reflector (6) associated with the incandescent body for bundling of light emitted from the incandescent body; and a photoconductor, in which light emitted from the reflector (6) in a direction of an optical axis (10) is coupled-in by means of a coupling-in surface (12) of the photoconductor (8), wherein the incandescent body longitudinal axis (4) forms an angle ($\alpha$) with the optical axis (10) of >0 degrees.

2. The headlight as defined in claim 1, wherein the angle ($\alpha$) between the incandescent body longitudinal axis (4) and the optical axis (10)$\geqq$30 degrees.

3. The headlight as defined in claim 1, wherein the angle ($\alpha$) between the incandescent body longitudinal axis (4) and the optical axis $\geqq$45 degrees.

4. The headlight as defined in claim 1, wherein the angle ($\alpha$) between the incandescent body longitudinal axis (4) and the optical axis (10)$\geqq$60 degrees.

5. The headlight as defined in claim 1, wherein the angle ($\alpha$) between the incandescent body longitudinal axis (4) and the optical axis (10)=90 degrees.

6. The headlight as defined in claim 1, wherein incandescent body images (64, 66) emitted from the incandescent body (2) and bundled from the reflector (6) are produced with large and small projection surfaces.

7. The headlight as defined in claim 1, wherein the photoconductor (8) and/or the coupling-in surface (12) have a non-circular cross section with an extension in a longitudinal and a transverse direction (56, 72; 56, 74).

8. The headlight as defined in claim 7, wherein the photoconductor (8) and/or the coupling-in surface (12) have a cross section with a maximum extension in a longitudinal direction.

9. The headlight as defined in claim 7, wherein the photoconductor and/or the coupling-in surface have a cross section with a maximum extension (60), wherein a direction of the maximum extension deviates from a direction of the longitudinal extension (54) of the cross section.

10. The headlight as defined in claim 9, wherein the incandescent body images (64, 66) with large projection surfaces lie parallel to a maximum extension (60) of the coupling-in surface (12) of the photoconductor (8).

11. The headlight as defined in claim 6, wherein the incandescent images (64, 66) with small projection surfaces lie in regions of the coupling-in surface that are not covered or only partially covered by incandescent body images with large projection surfaces.

12. The headlight as defined in claim 1, wherein the incandescent body (2) is formed as an incandescent coil.

13. The headlight as defined in claim 1, wherein the incandescent body (20) is formed as an arc lamp.

14. The headlight as defined in claim 13, wherein the arc lamp is produced from a gas discharge lamp.

* * * * *